US010627067B2

(12) United States Patent
Nykerk et al.

(10) Patent No.: US 10,627,067 B2
(45) Date of Patent: Apr. 21, 2020

(54) REFLECTOR LAMP

(71) Applicant: Flex-N-Gate Advanced Product Development, LLC, Tecumseh (CA)

(72) Inventors: Todd Nykerk, Holland, MI (US); Les Sullivan, Wyoming, MI (US)

(73) Assignee: Flex-N-Gate Advanced Product Development, LLC, Tecumseh (CA)

( * ) Notice: Subject to any disclaimer, the term of this patent is extended or adjusted under 35 U.S.C. 154(b) by 0 days.

(21) Appl. No.: 16/142,628

(22) Filed: Sep. 26, 2018

(65) Prior Publication Data

US 2019/0101259 A1 Apr. 4, 2019

Related U.S. Application Data

(60) Provisional application No. 62/565,378, filed on Sep. 29, 2017.

(51) Int. Cl.

| | |
|---|---|
| ***F21S 41/33*** | (2018.01) |
| ***F21S 45/10*** | (2018.01) |
| ***F21S 41/151*** | (2018.01) |
| ***F21S 41/147*** | (2018.01) |
| ***F21S 41/32*** | (2018.01) |
| ***F21S 41/20*** | (2018.01) |
| ***F21V 7/10*** | (2006.01) |
| *F21Y 103/10* | (2016.01) |
| *F21W 103/55* | (2018.01) |
| *F21Y 115/10* | (2016.01) |

(52) U.S. Cl.

CPC ..... *F21S 41/33* (2018.01); *F21S 41/147* (2018.01); *F21S 41/285* (2018.01); *F21S 41/32* (2018.01); *F21V 7/10* (2013.01); *F21S 41/151* (2018.01); *F21S 45/10* (2018.01); *F21W 2103/55* (2018.01); *F21Y 2103/10* (2016.08); *F21Y 2115/10* (2016.08)

(58) Field of Classification Search

CPC ..... F21S 41/33; F21S 41/151; F21S 45/10

See application file for complete search history.

(56) References Cited

U.S. PATENT DOCUMENTS

| | | | |
|---|---|---|---|
| 5,584,570 | A | 12/1996 | Binder et al. |
| 2004/0012975 | A1 | 1/2004 | Chase et al. |
| 2014/0063779 | A1 | 3/2014 | Bradford |

FOREIGN PATENT DOCUMENTS

| | | | |
|---|---|---|---|
| GB | 2497324 | A | 6/2013 |

OTHER PUBLICATIONS

PCT Patent Application No. PCT/US2018/053399 International Search Report and Written Opinion dated Jan. 17, 2019.

*Primary Examiner* — Joseph L Williams

(74) *Attorney, Agent, or Firm* — Erise IP, P.A.

(57) ABSTRACT

A vehicle reflector lamp includes a curved reflector having a reflective front side and a non-reflective back side opposite the front side. The curved reflector has a light-permeable slot. A light source is positioned behind the non-reflective back side such that light emanates from the light source through the light-permeable slot for reflecting off the reflective front side. An optical sheet is positioned adjacent the front side of the reflector for homogenizing light reflected from the reflector, and a clear outer lens protects the optical sheet, the light source, and the curved reflector from an outdoor environment. The reflector lamp has a lit mode and an unlit mode. When in the unlit mode, ambient light reflects off of the reflective front side. When in the lit mode, light from the light source reflects of at least a portion of the reflective front side.

16 Claims, 3 Drawing Sheets

REFLECTOR LAMP

CROSS-REFERENCE TO RELATED APPLICATIONS

This application claims the benefit of U.S. Provisional Patent Application Ser. No. 62/565,378 entitled Reflector Lamp and filed Sep. 29, 2017, the disclosure of which is herein incorporated by reference in its entirety.

BACKGROUND

1. Field of the Disclosure

Embodiments of this disclosure relate generally to vehicle lamps. More specifically, embodiments of this disclosure include lamps configured to provide a homogenous illumination from a light source when lit and a reflective surface when unlit.

2. Description of the Related Art

None.

SUMMARY

In an embodiment, a vehicle reflector lamp is provided. The vehicle reflector lamp includes a curved reflector having a reflective front side and a non-reflective back side opposite the front side. The curved reflector has a light-permeable slot. A light source is positioned behind the non-reflective back side such that light emanates from the light source through the light-permeable slot for reflecting off the reflective front side. An optical sheet is positioned adjacent the front side of the reflector for homogenizing light reflected from the reflector, and a clear outer lens protects the optical sheet, the light source, and the curved reflector from an outdoor environment.

In another embodiment, a reflector lamp for external use on a vehicle having a lit mode and an unlit mode is provided. The reflector lamp includes an array of light-emitting diodes (LEDs) for producing light in the lit mode. A reflector is provided for reflecting ambient light when in the unlit mode. The reflector has a slot for receiving light from the light source when operated in the lit mode, such that light passes through the slot and illuminates at least a portion of the reflector.

BRIEF DESCRIPTION OF THE DRAWINGS

Illustrative embodiments of the present disclosure are described in detail below with reference to the attached drawing figures, which are incorporated by reference herein and wherein.

DETAILED DESCRIPTION

Figure 1:
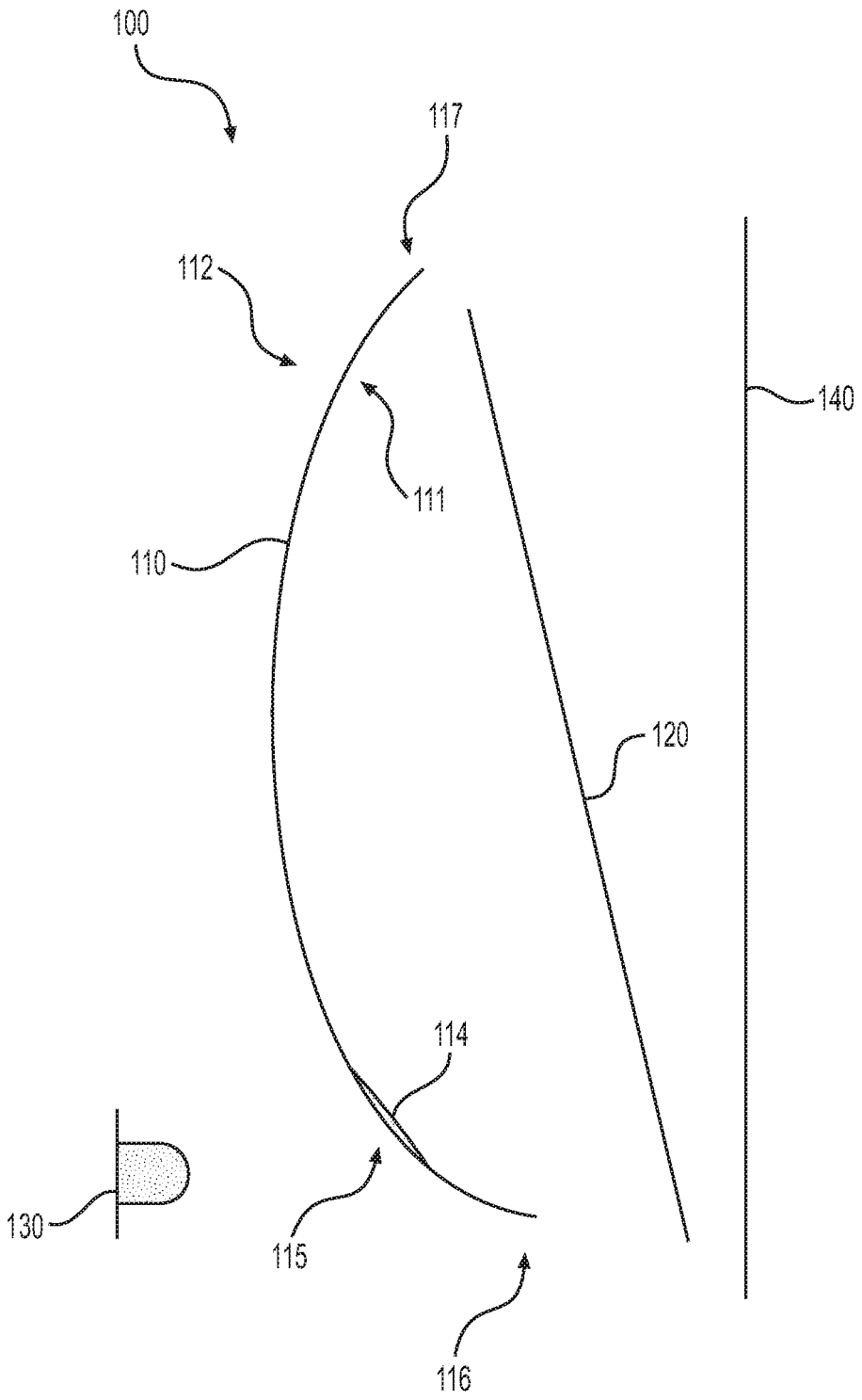
FIG. 1 is a cross-sectional side view of a reflector lamp, in an embodiment.

FIG. 1 is a cross-sectional side view of an exemplary reflector lamp 100. Reflector lamp 100 includes a reflector 110, an optical sheet 120, a light source 130 and a clear outer lens 140. Reflector 110 faces away from light source 130 and towards optical sheet 120. In other words, reflector 110 has a non-reflective back side 112 that faces light source 130 and a reflective front side 111 that faces optical sheet 120. In certain embodiments, curved reflector 110 has a curvature such that back side 112 is convex and front side 111 is concave. In some embodiments, the curvature of curved reflector 110 is asymmetrical. For example, as depicted in FIG. 1, curved reflector 110 has an increased curvature (e.g., a shorter radius of curvature) near a first end 116. In some embodiments, the curvature near first end 116 is greater than a curvature near a second end 117.

A reflective surface of reflector 110 is for example a chrome reflector with front side 111 having a chrome appearance (e.g., a chrome plating, a chrome finish, or an imitation chrome finish). In other words, front side 111 has the appearance of a shiny metal surface.

Light source 130 is, for example, one or more light-emitting diodes (LEDs). In some embodiments, light source 130 is an array of LEDs such as a linear single-string array; however, light source 130 may include multiple arrays of LEDs (e.g., aligned in parallel) without departing from the scope hereof.

A light-permeable slot 115 allows light from light source 130 to emanate through reflector 110 and reflect off its reflective front side 111. In certain embodiments, light-permeable slot 115 is positioned near one end of curved reflector 110, as opposed to a position near the middle of curved reflector 110. For example, as depicted in FIG. 1, light-permeable slot 115 is positioned near a first end 116 of curved reflector 110.

In certain embodiments, an optical cover 114 is positioned over light-permeable slot 115 for smoothing light from light source 130. As depicted in FIG. 1, optical cover 114 may be positioned on a front side 111 of curved reflector 110; however, optical cover may alternatively be positioned on a back side 112. Examples of optical cover 114 include one or more transparent films or one or more optical sheets configured to cover light-permeable slot 115. Alternatively, optical cover 114 may include non-imaging optics such as one or more lenses capable of manipulating light from light source 130. In some embodiments, optical cover 114 includes two lenses between light source 130 and light-permeable slot 115.

Optical sheet 120 is for example a transparent and flexible lens or film used to homogenize or smooth light from reflector 110 so that it appears more uniform and homogenous and provides a desired light emission profile. In certain embodiments, optical sheet 120 is a lenticular sheet having a desired number of lines per inch for providing a desired viewing angle. Alternatively, optical sheet 120 is a diffusion sheet or light shaping diffuser. In some embodiments, optical sheet 120 is treated (e.g., thermally and/or chemically) to increase its transparency.

Clear outer lens 140 encloses components of reflector lamp 100 for protection from conditions of an outdoor environment. Clear outer lens 140 may be aligned parallel with optical sheet 120 or at a non-parallel angle (e.g., as depicted in FIG. 1) without departing from the scope hereof.

In operation, reflector lamp 100 uses two modes. In a first mode, light source 130 is turned on such that the reflector lamp 100 is actively lit (e.g., a "lit mode"). In a second mode, light source 130 is turned off (e.g., an "unlit mode").

Figure 2:
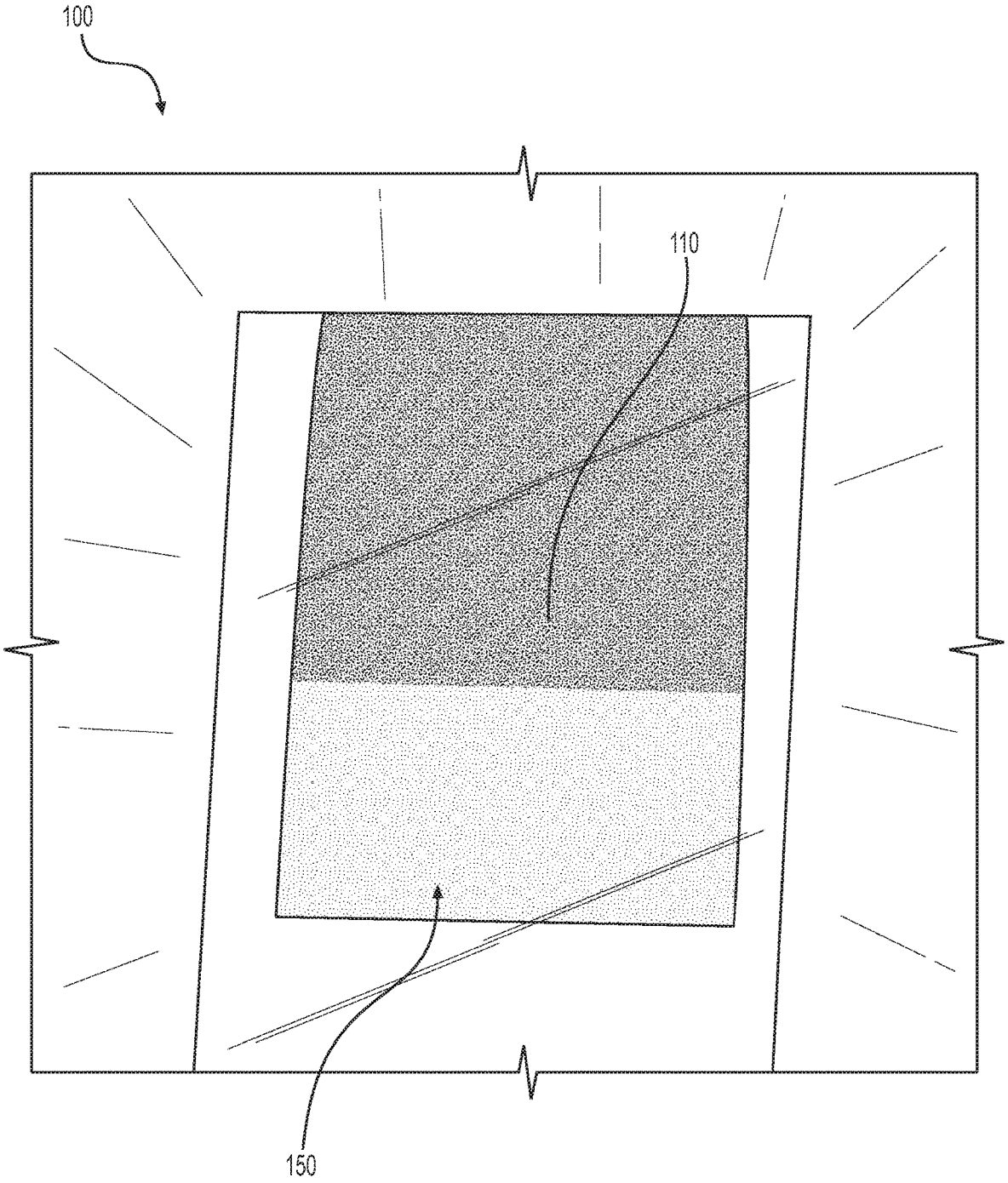
FIG. 2 is a perspective view of a reflector lamp when operated in a lit mode, in an embodiment.

FIG. 2 is a perspective view of an exemplary reflector lamp 100 when operated in the lit mode. In the lit mode, reflector 110 reflects light from light source 130 through optical sheet 120 and clear outer lens 140 to provide a homogeneous illumination. The lit mode may be used to provide daytime running lamp (DRL) functionality, for example. As depicted in FIG. 2, a portion of reflector 110 is illuminated to provide homogenous illumination in an illumination area 150. The portion illuminated is towards the opposite end of curved reflector 110 from light-permeable slot 115. In other embodiments, reflector 110 is configured such that illumination area 150 is expanded. For example, illumination area 150 may include the entire front-side surface area of reflector 110.

Figure 3:
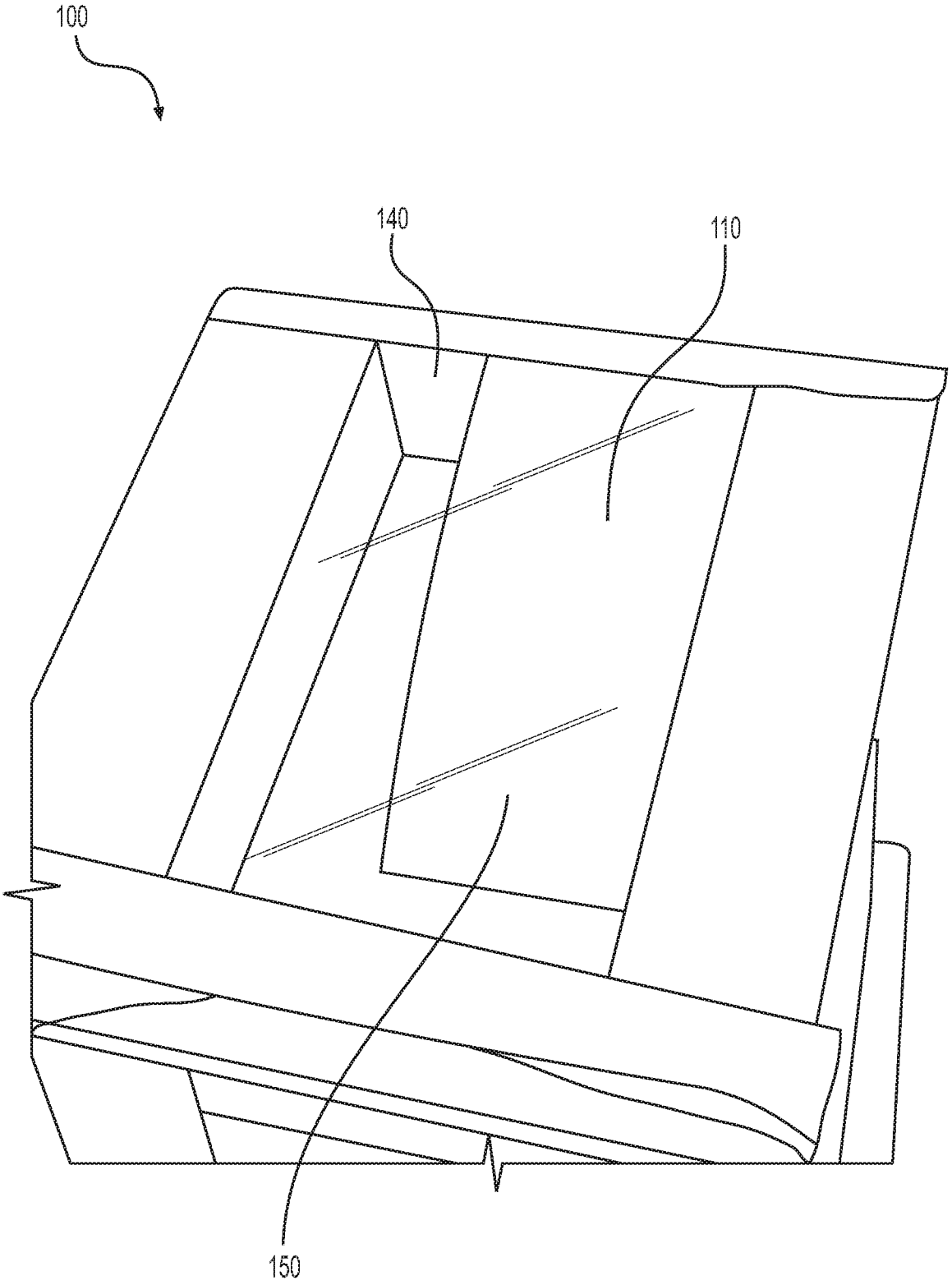
FIG. 3 is a perspective view of the reflector lamp of FIG. 2 when operated in an unlit mode.

FIG. 3 is a perspective view of reflector lamp 100 when operated in the unlit mode. In the unlit mode, light source 130 is off such that curved reflector 110 is unilluminated. Instead, reflector 110 appears as a uniform chrome reflector that reflects ambient light entering lamp 100 via clear outer lens 140. In other words, lamp 100 is configured to appear as a uniform chrome surface under clear outer lens 140 when operated in the unlit mode. Reflector 110 and optical sheet 120 are configured to provide a desired color, flatness, and reflectivity in the unlit mode.

In certain embodiments, light source 130 is not visible from a view of reflector 110 through clear outer lens 140. When viewing reflector 110, light source 130 is not directly visible due to the position of light source 130 behind reflector 110 combined with the position of light-permeable slot 115 and possibly, but not necessarily, the curvature of reflector 110. As depicted in FIG. 1, light source 130 is aligned with a lower edge of optical cover 114; however, optical sheet 120 elongates the illuminated image of optical cover 114 making it appear to block a direct view of light source 130.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all operations listed in the various figures need be carried out in the specific order described.

The invention claimed is:

1. A vehicle reflector lamp, comprising:

a curved reflector having a reflective front side and a non-reflective back side opposite the front side, the curved reflector having a light-permeable slot;

a light source positioned behind the non-reflective back side such that light emanates from the light source through the light-permeable slot for reflecting off the reflective front side;

an optical sheet positioned adjacent the front side of the reflector for homogenizing light reflected from the reflector; and a clear outer lens for protecting the optical sheet, the light source, and the curved reflector from an outdoor environment.

2. The vehicle reflector lamp of claim 1, wherein the curved reflector presents a reflective surface having a chrome appearance.

3. The vehicle reflector lamp of claim 1, wherein the reflective front side has a concave curvature.

4. The vehicle reflector lamp of claim 1, wherein the light source comprises a plurality of light-emitting diodes (LEDs).

5. The vehicle reflector lamp of claim 4, wherein the light source comprises a linear single-string array of LEDs.

6. The vehicle reflector lamp of claim 1, further comprising an optical cover positioned over the light-permeable slot for smoothing light from the light source.

7. The vehicle reflector lamp of claim 1, wherein the light-permeable slot is positioned near a first end of the curved reflector having a greater curvature compared to a second end of the curved reflector, opposite the first end.

8. The vehicle reflector lamp of claim 1, further comprising a homogenous illumination emanating from at least a portion of the vehicle reflector lamp when operated in a lit mode.

9. The vehicle reflector lamp of claim 1, further comprising a uniform chrome reflective appearance when operated in an unlit mode.

10. The vehicle reflector lamp of claim 1, wherein the light source is not directly visible through the clear outer lens from outside.

11. A reflector lamp for external use on a vehicle having a lit mode and an unlit mode, comprising:

an array of light-emitting diodes (LEDs) for producing light in the lit mode;

a reflector for reflecting ambient light when in the unlit mode, the reflector having a slot positioned off-center for receiving light from the light source when operated in the lit mode, such that light passes through the slot and illuminates at least a portion of the reflector; and the reflector having an asymmetrical curvature such that a portion of the reflector opposite the slot is illuminated when operated in the lit mode.

12. The reflector lamp of claim 11, further comprising an optical sheet adapted to homogenize light reflected from the reflector in both the lit mode and the unlit mode.

13. The reflector lamp of claim 11, further comprising a clear outer lens for protecting components of the reflector lamp from an outdoor environment.

14. The reflector lamp of claim 11, further comprising an optical cover adjacent the slot for smoothing light from the array of LEDs.

15. The vehicle reflector lamp of claim 11, wherein the slot is positioned near a first end of the reflector having a greater curvature compared to a second end of the reflector, opposite the first end.

16. A vehicle reflector lamp, comprising:

a curved asymmetric reflector having a reflective front side and a non-reflective back side opposite the front side, the curved asymmetric reflector having an off-centered slot;

a light source positioned behind the non-reflective back side such that light emanates from the light source through the off-centered slot for reflecting directly off the reflective front side;

an optical cover positioned over the light-permeable slot for smoothing light from the light source;

an optical sheet positioned adjacent the reflective front side for homogenizing light reflected from the curved asymmetric reflector; and an outer lens disposed adjacent the optical sheet, opposite the curved asymmetric reflector, for protecting the optical sheet, the light source, and the curved asymmetric reflector.

* * * * *